US012631089B2

(12) United States Patent
King

(10) Patent No.: US 12,631,089 B2
(45) Date of Patent: May 19, 2026

(54) RESETTABLE CONFIGURABLE INTERCEPT SUB SURFACE CONTROL VALVE

(71) Applicant: Halliburton Energy Services, Inc., Houston, TX (US)

(72) Inventor: Douglas King, Waxahachie, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 161 days.

(21) Appl. No.: 18/298,656

(22) Filed: Apr. 11, 2023

(65) Prior Publication Data

US 2024/0344424 A1 Oct. 17, 2024

(51) Int. Cl.
*E21B 34/10* (2006.01)

(52) U.S. Cl.
CPC ..... *E21B 34/10* (2013.01); *E21B 2200/04* (2020.05)

(58) Field of Classification Search
CPC ..... E21B 34/10; E21B 2200/04; E21B 23/06; E21B 23/04
See application file for complete search history.

(56) References Cited

U.S. PATENT DOCUMENTS 3,499,487 A * 3/1970 Barrington ..... E21B 34/125 166/237
3,831,632 A * 8/1974 Young ..... F16K 17/34 137/460
3,986,554 A * 10/1976 Nutter ..... E21B 49/087 251/63.4
4,063,593 A * 12/1977 Jessup ..... E21B 49/081 166/321
4,181,186 A * 1/1980 Blanton ..... E21B 31/113 29/888.06
4,422,506 A * 12/1983 Beck ..... E21B 34/108 166/324
4,444,268 A * 4/1984 Barrington ..... E21B 49/087 166/324
4,448,254 A * 5/1984 Barrington ..... E21B 34/14 166/324

(Continued)

FOREIGN PATENT DOCUMENTS

| | | | |
|---|---|---|---|
| CN | 115478823 | A | 12/2022 |
| EP | 0480584 | A2 | 4/1992 |
| WO | 1995009964 | A1 | 4/1995 |

OTHER PUBLICATIONS

International Search Report and Written Opinion for International Patent Application No. PCT/US2023/020225 dated Dec. 28, 2023. PDF file. 7 pages.

(Continued)

*Primary Examiner* — Steven A Macdonald
(74) *Attorney, Agent, or Firm* — Scott Richardson; C. Tumey Law Group PLLC

(57) ABSTRACT

Systems and methods of the present disclosure relate to shifting mandrels in downhole tools based on hydraulic pressure. A downhole tool includes an outer sleeve, an inner mandrel and a valve plate coupled to the inner mandrel. The valve plate and the inner mandrel are configured to shift axially within the outer sleeve. The valve plate is further configured to pass a portion of fluid through the valve plate and pass another portion of the fluid around the valve plate, based on a tensile force or a compressive force exerted on the downhole tool.

20 Claims, 4 Drawing Sheets

(56) References Cited

U.S. PATENT DOCUMENTS

| | | | | | |
|---|---|---|---|---|---|
| 4,489,786 | A | * | 12/1984 | Beck | E21B 34/108 166/321 |
| 4,515,219 | A | * | 5/1985 | Beck | E21B 34/108 166/324 |
| 4,537,258 | A | * | 8/1985 | Beck | E21B 49/001 166/374 |
| 4,557,333 | A | * | 12/1985 | Beck | E21B 49/001 166/321 |
| 4,595,060 | A | * | 6/1986 | Beck | E21B 34/108 166/324 |
| 4,617,999 | A | * | 10/1986 | Beck | E21B 49/001 166/324 |
| 4,651,829 | A | | 3/1987 | Hushbeck et al. | |
| 4,665,991 | A | * | 5/1987 | Manke | E21B 34/108 166/321 |
| 4,979,568 | A | * | 12/1990 | Spencer, III | E21B 23/006 166/321 |
| 5,156,207 | A | * | 10/1992 | Haugen | E21B 34/108 166/321 |
| 5,180,015 | A | | 1/1993 | Ringgenberg et al. | |
| 5,810,087 | A | * | 9/1998 | Patel | E21B 34/108 166/373 |
| 6,488,260 | B1 | | 12/2002 | Dietz | |
| 6,585,228 | B1 | | 7/2003 | McCaskill | |
| 9,291,033 | B2 | | 3/2016 | Scott et al. | |
| 9,909,387 | B2 | | 3/2018 | Scott et al. | |
| 10,961,819 | B2 | | 3/2021 | Honeker et al. | |
| 11,686,177 | B2 | | 6/2023 | AlSultan et al. | |
| 2012/0186829 | A1 | | 7/2012 | Watson | |
| 2012/0312540 | A1 | | 12/2012 | Lefebvre | |
| 2018/0058145 | A1 | | 3/2018 | Tutt | |
| 2020/0284144 | A1 | | 9/2020 | Andreychuk et al. | |
| 2022/0220820 | A1 | | 7/2022 | Stewart et al. | |

OTHER PUBLICATIONS

Halliburton, EcoStar Electric Tubing-Retrievable Safety Valve, Completion Solutions, H012530, Apr. 2020.

European Patent Office Extended European Search Report for EPO Application No. 24156100.0 dated Aug. 2, 2024. PDF file. 8 pages.

* cited by examiner

RESETTABLE CONFIGURABLE INTERCEPT SUB SURFACE CONTROL VALVE

BACKGROUND

During some oilfield operations, a shear device may be deployed to set a tandem bridge plug. Once deployed, any downward movement on the tool string while drag blocks are engaged results in a ball valve being closed and can create a hydraulic lock between plugs during retrieval.

BRIEF DESCRIPTION OF THE DRAWINGS

These drawings illustrate certain aspects of some examples of the present disclosure and should not be used to limit or define the disclosure.

DETAILED DESCRIPTION

The present disclosure relates to systems and methods that use a valve plate rather than shear pins to shift downhole components in a downhole tool. The valve plate includes a pressure relief valve and a bypass feature. This allows the valve to be resettable to an open position and require the configured setting force, to close multiple times. The system may be used to set tandem bridge plugs.

The system utilizes a valve plate with a specifically configured set of valves that are in a tensile path of the tool (e.g., pull up on tool string). The system resists a relative motion of components that allow a ball to move from an open to closed position (e.g., a ball valve), until a desired/threshold compressive force is applied to the tool string. During closing, the valve plate unseats from a seal bore and moves a distance until the valve plate is bypassed. The valve plate may be disposed in a silicone filled fluid cavity and may be segregated from wellbore fluid. When a tensile load is applied to the tool string, the valve plate re-seats in the bore, and fluid passes freely through check valves in the valve plate until the ball is in the open position.

Figure 1:
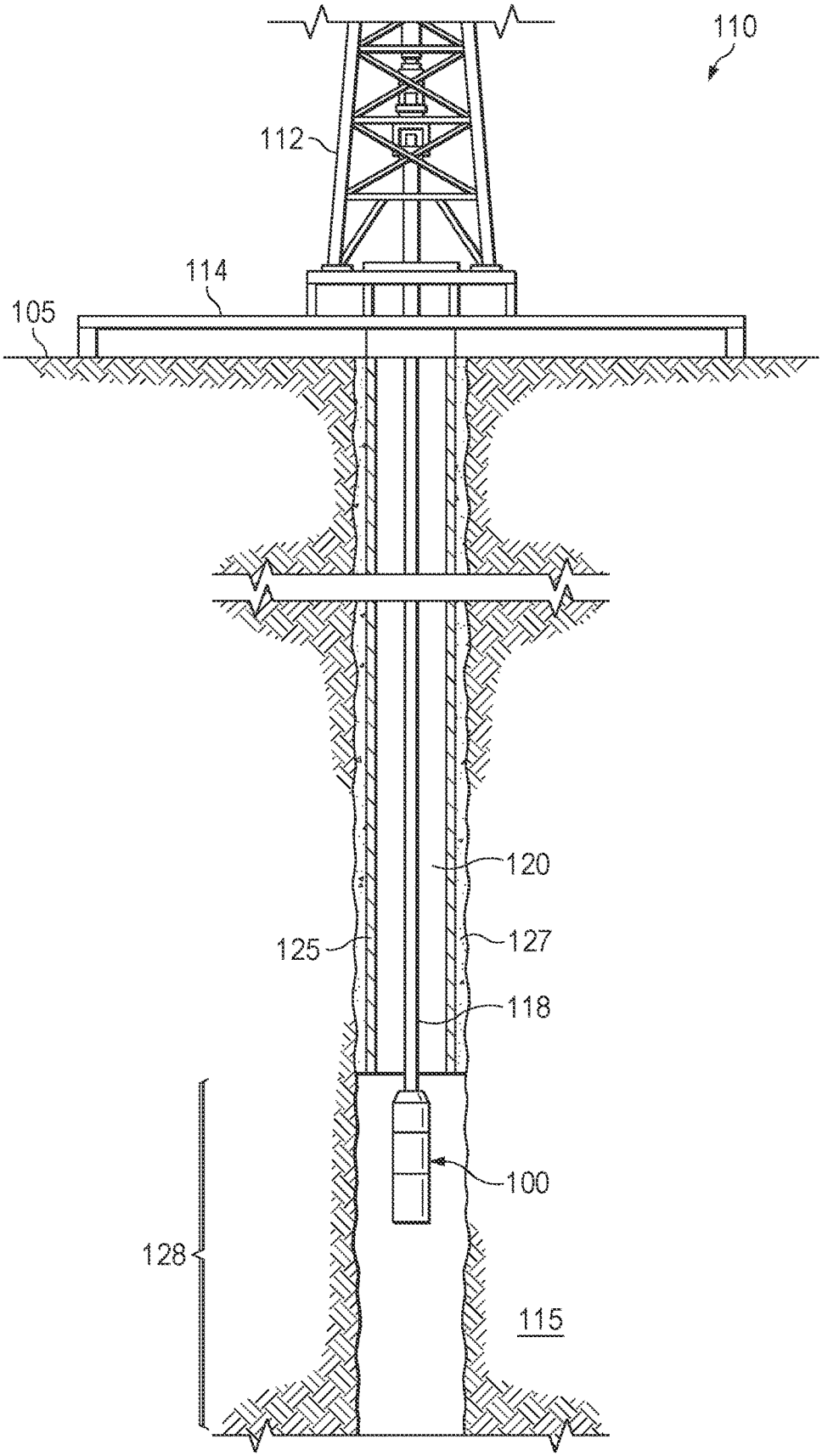
FIG. 1 illustrates an operating environment for a downhole tool, in accordance with examples of the present disclosure.

FIG. 1 illustrates a well system 110 (operating environment) for a downhole tool 100 (retrieval tool), in accordance with examples of the present disclosure. In some examples, the downhole tool 100 may be used to set a plug (e.g., tandem bridge plug) from a wellbore. A derrick 112 with a rig floor 114 is positioned on the earth's surface 105. A wellbore 120 is positioned below the derrick 112 and the rig floor 114 and extends into a subterranean formation 115. The wellbore 120 may be lined with casing 125 that is cemented in place with cement 127. Although FIG. 1 depicts the wellbore 120 having a casing 125 being cemented into place with cement 127, the wellbore 120 may include open hole portion 128. Moreover, the wellbore 120 may be an open-hole wellbore. The well system 110 may equally be employed in vertical and/or deviated wellbores.

A tool string 118 extends from the derrick 112 and the rig floor 114 downwardly into the wellbore 120. The tool string 118 may be any mechanical connection to the surface, such as, for example, jointed pipe, wireline, slickline, or coiled tubing. As depicted, the tool string 118 suspends the downhole tool 100 for placement into the wellbore 120 at a desired location to perform a specific downhole operation (e.g., setting or retrieving bridge plug).

Figure 2A:
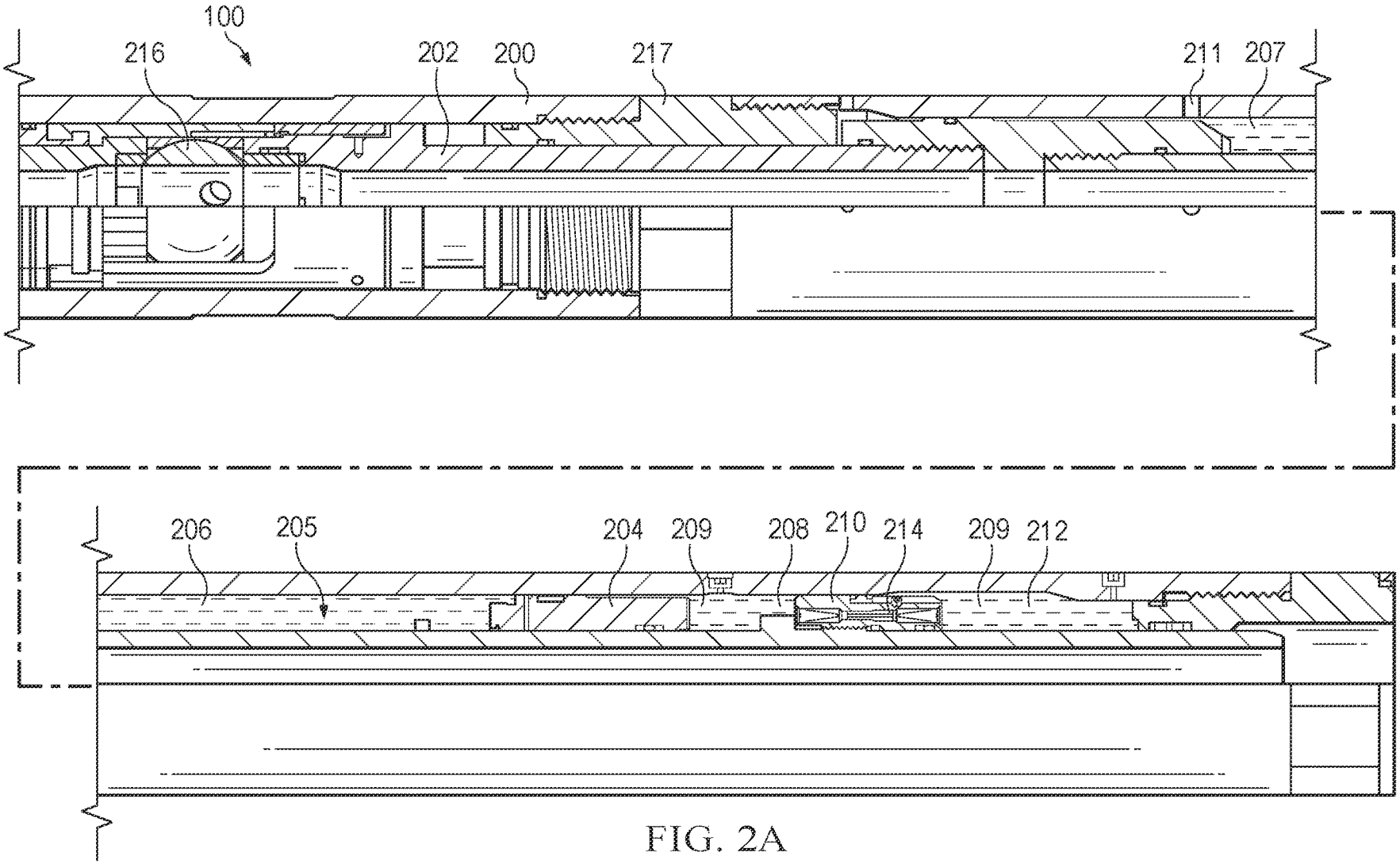
FIG. 2A illustrates the downhole tool including resettable and configurable subsurface control valves, in accordance with examples of the present disclosure.

FIG. 2A illustrates a cutaway view of the tool 100, in accordance with examples of the present disclosure. The tool 100 includes an outer sleeve 200 and an inner mandrel 202 that is movable in axial directions upon exerting a threshold compressive or tensile force on the tool. A balancing piston 204 is movably disposed in a chamber 205 such that it separates the chamber 205 into a first chamber section 206 and a second chamber section 208.

The first chamber section 206 may include a fluid 207 (e.g., wellbore fluid) that may enter the first chamber section 206 via a port 211. The first chamber section 206 and the second chamber section 208 and the balancing piston 204 may be disposed between the outer sleeve 200 and the inner mandrel 202. The chamber sections 206 and 208 are not in fluid communication due to segregation via the balancing piston 204 that is movably disposed therebetween.

The second chamber section 208 may be positioned between the balancing piston 204 and a valve plate 210. The valve plate 210 is fixed to the inner mandrel 202 and moves with the inner mandrel upon manipulation of axial forces against the tool string or inner mandrel of the tool. The second chamber section 208 may include a fluid 209 (e.g., a clean oil bath). The balancing piston 204 only acts as a barrier between the clean oil and wellbore fluids as well as reducing thermal effects of the fluids.

The valve plate 210 may be positioned between the second chamber section 208 and a third chamber section 212. The third chamber section 212 may also include a portion of the fluid 209. The chamber sections 208 and 212 are in fluid communication. That is, fluid may move to or from each chamber section into the other chamber section. In some examples, the valve plate 210 may be disposed in silicone and may be segregated from the wellbore fluid in 206. The chamber sections may include sections of a single chamber or include separate chambers. The chamber sections (or chambers) may be positioned along a length (longitudinal axis L) of the tool 100.

As the tool string is compressed (closing), the inner mandrel 202 cannot move until an amount of force required to open a valve 214 in the valve plate 210 is achieved. Until this force is achieved, a ball 216 will remain in an open position within the tool string or tool. This allows manipulation of the tool string or tool to move the ball 216 into open and closed positions multiple times, and at desired times.

To shift the ball 216 to a closed position in the tool 100, the valve plate 210 and inner mandrel 202 move forward forcing the fluid 209 from the chamber section 212 through the valve 214 (e.g., check valve) and into the chamber section 208. Also, as the valve plate 210 moves forward, fluid 209 begins to bypass/flow around the valve plate 210 and flow into the chamber section 208 from the chamber section 212. This causes/shifts the ball 216 to a closed position. That is, the ball 216 moves downhole into a section 217 of the tool 100 and blocks/closes the section 217.

To shift the ball 216 back to the open position, a tensile strength is applied to the tool string (e.g., inner mandrel 202 is pulled up) and the valve 214 allow the fluid 209 to flow into the chamber section 212 from the chamber section 208. Also, the bypass allows the fluid 209 to flow around the valve plate 210 and back into the chamber section 212 from the chamber section 208 until the bypass is sealed. The valve 214 may be a configurable pressure relief valve that allows flow upon satisfying threshold pressure conditions specific to the valve.

Figure 2B:
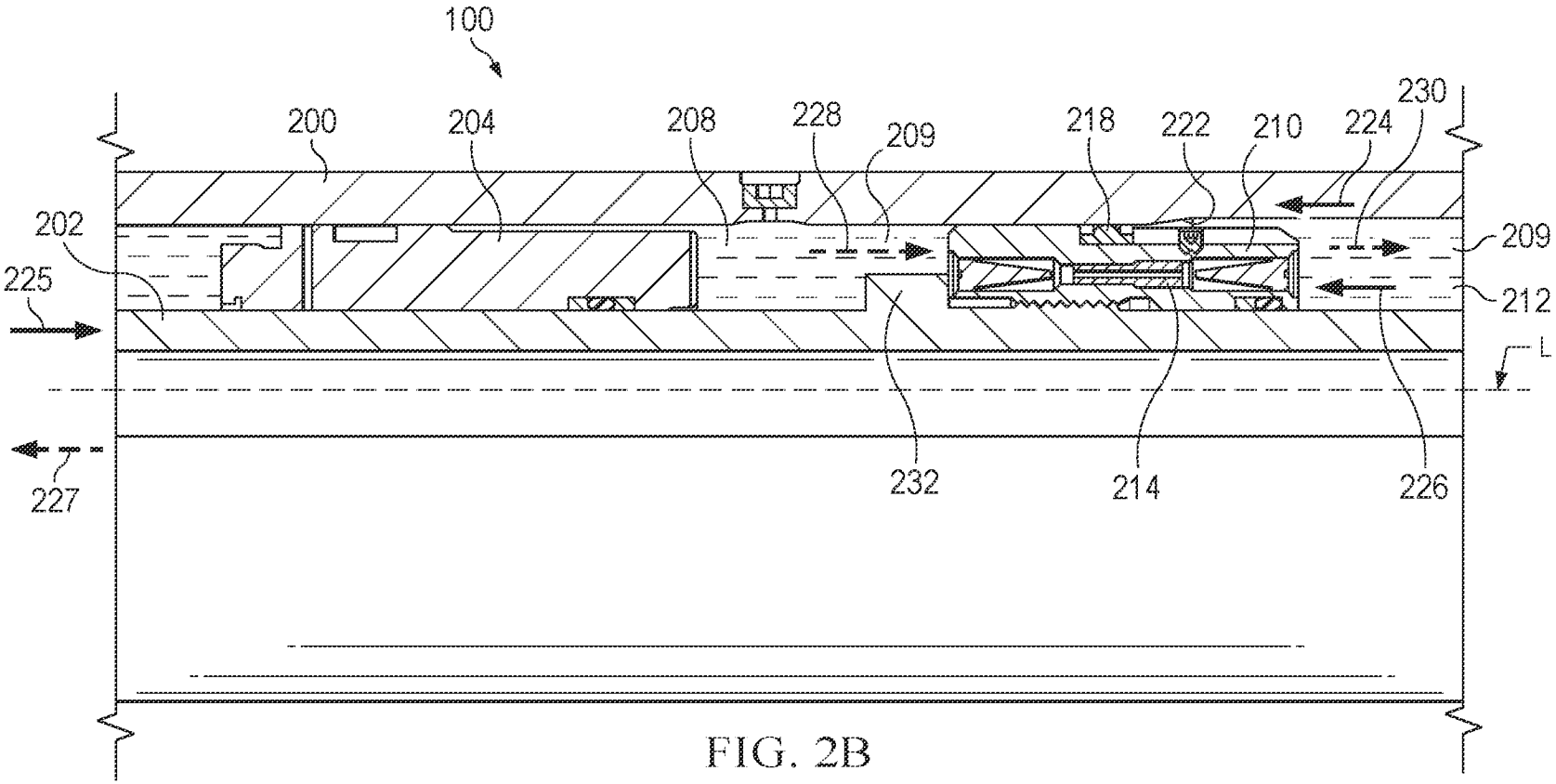
FIG. 2B illustrates a close-up of the downhole tool, in accordance with examples of the present disclosure.

FIG. 2B illustrates a close-up view of the valve plate 210, in accordance with examples of the present disclosure. A seal 218 (e.g., T-shaped seal) may be included in the valve plate 210 to seal against an inner section 220 of the outer sleeve 200. The inner section 220 may also include a tapered portion 222 configured to allow a portion of the fluid 209 in the chamber section 212 to move around the valve plate 210 (a bypass) and flow into the chamber section 208 as the valve plate 210 is pushed forward forcing fluid 209 backward (arrow 224) as the valve 214 passes fluid back into the chamber section 208 (arrow 226). This occurs during shifting of the ball 216 to a closed position (arrow 225). Also, as the valve plate 210 moves forward along the tapered portion, fluid 209 is released and begins to bypass/flow around the valve plate 210 via the tapered portion 222 and flow into the chamber section 208 from the chamber section 212.

As noted above, the inner mandrel 202 is connected directly to the valve plate 210 such that both components move in unison. During shifting of the ball 216 to an open position (tensile force against the inner mandrel, arrow 227), the fluid flows through the valve 214 (arrow 228) into the chamber section 212 (arrow 230). Also, the bypass/tapered portion 222 allows the fluid 209 to flow around the valve plate 210 and back into the chamber section 212 from the chamber section 208 until the bypass is sealed due to re-seating of the valve plate 210 within a seat 232 (e.g., initial position). Arrows 227, 228, and 230 indicate dynamics during tensile force/pulling up on the tool string. Arrows 224, 225, and 226 indicate dynamics during compression on the tool string.

Figure 3:
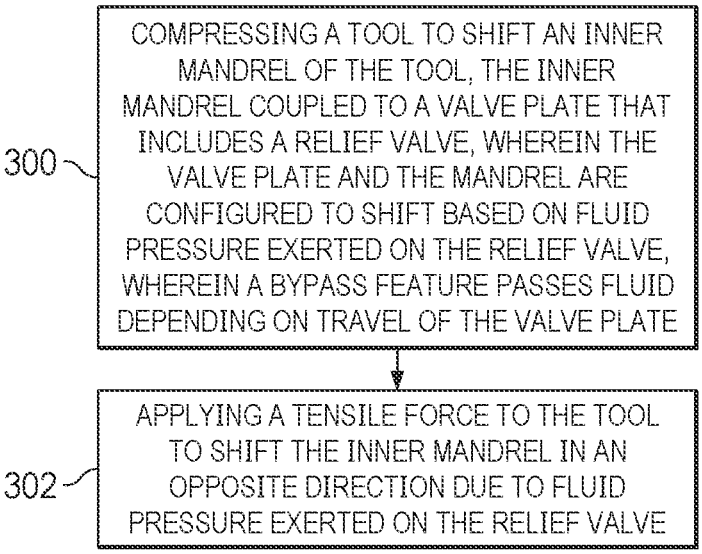
FIG. 3 illustrates an operative sequence for the downhole tool, in accordance with examples of the present disclosure.

FIG. 3 illustrates an operative sequence of the tool 100, in accordance with examples of the present disclosure. At step 300, compressing a tool string to shift an inner mandrel occurs. Compression of the tool string forces a ball to move into a closed position within the tool. As noted above, the tool employs a valve plate that includes a pressure relief valve and a bypass feature (e.g., tapered profile). This allows the valve to be resettable to the open position and require the configured setting force, to close multiple times. The system may be used to set tandem bridge plugs.

With additional reference to FIG. 2B, during closing, the valve plate 210 and inner mandrel 202 move forward forcing the fluid 209 from the chamber section 212 through the valve 214 and into the chamber section 208. Also, as the valve plate 210 moves forward a certain distance, fluid 209 begins to bypass/flow around the valve plate 210 and flow into the chamber section 208 from the chamber section 212. This causes/shifts the ball 216 to a closed position. That is, the ball 216 moves downhole into a section 217 of the tool 100.

At step 302, a tensile force may be applied to the tool to shift the inner mandrel in an opposite direction. With additional reference to FIG. 2B, to shift the ball 216 to an open position, a tensile strength is applied to the tool string (e.g., inner mandrel is pulled up) and the valve 214 allow the fluid 209 to flow into the chamber section 212 from the chamber section 208. Also, the bypass allows the fluid 209 to flow around the valve plate 210 and back into the chamber section 212 from the chamber section 208 until the bypass is sealed. The valve 214 may be a configurable pressure relief valve that allows flow upon satisfying threshold pressure conditions specific to each configurable valve. As compression (e.g., 10-30 kip or more) is applied to the tool string (e.g., as shown on FIG. 1) to close the ball valve (e.g., the ball 216), the outer sleeve 200 is urged to move to the right/downhole. For this to occur, the fluid in the chamber section 212 (a first fluid volume) must be allowed to flow to the chamber section 208 (a second fluid volume). This cannot happen until the desired amount of weight has been set down on the tool string. Once the ball valve (the ball 216) has been closed. A tensile force (e.g., 10-30 kip or more) may be applied to bring the outer sleeve 200 back to its initial state. This allows opening and closing of the ball valve as desired. The size of the chamber section 212 may dictate how the relief valve 214 is configured. For example, if it is desired to close the ball valve at 20 kip compression, the size of the chamber section 212 may be 10 square inches resulting in a ball valve with a cracking pressure of 2000 psi. The valve 214 (e.g., check valve) blocks flow from the chamber section 212 to the chamber section 208 and allows flow from the chamber section 208 to the chamber section 212. This allows a reset of the tool 100 by only overcoming a sealing friction (e.g., the seal 218).

Accordingly, the systems and methods of the present disclosure allow for use of a valve plate rather than shear pins to shift downhole components in a tool string. The systems and methods may include any of the various features disclosed herein, including one or more of the following statements.

Statement 1. A downhole tool comprising: an outer sleeve; an inner mandrel; a valve plate coupled to the inner mandrel, the valve plate and the inner mandrel configured to shift axially within the outer sleeve, the valve plate further configured to pass a portion of fluid through the valve plate and pass another portion of the fluid around the valve plate, based on a threshold tensile force or a threshold compressive force exerted on the downhole tool.

Statement 2. The downhole tool of the statement 1, wherein the fluid is a bath oil.

Statement 3. The downhole tool of the statement 1 or the statement 2, further including a bypass to pass the portion of fluid around the valve plate, the bypass including a tapered portion.

Statement 4. The downhole tool of any one of the statements 1-3, wherein an interior of the outer sleeve includes the tapered portion.

Statement 5. The downhole tool of any one of the statements 1-4, wherein the valve plate includes a relief valve.

Statement 6. The downhole tool of any one of the statements 1-5, wherein a seal is disposed between the valve plate and an interior of the outer sleeve.

Statement 7. The downhole tool of any one of the statements 1-6, further including a ball disposed in the downhole tool, the ball configured to shift in the downhole tool upon shifting of the inner mandrel and the valve plate.

Statement 8. The downhole tool of any one of the statements 1-7, wherein the valve plate is disposed between two sections of a chamber filled with the fluid.

Statement 9. The downhole tool of any one of the statements 1-8, wherein the valve plate is configured to open or close based on pressure exerted on the valve plate by the fluid.

Statement 10. The downhole tool of any one of the statements 1-9, further including a piston movably disposed on the inner mandrel.

Statement 11. The downhole tool of any one of the statements 1-10, wherein the piston separates the fluid from a wellbore fluid.

Statement 12. A method comprising applying a compressive force or a tensile force to a downhole tool to shift an inner mandrel of the downhole tool, the tool including: an outer sleeve; an inner mandrel; and a valve plate coupled to the inner mandrel, the valve plate and the inner mandrel configured to shift axially within the outer sleeve, the valve plate further configured to pass a portion of fluid through the valve plate and pass another portion of the fluid around the valve plate, based on a threshold tensile force or a threshold compressive force exerted on the downhole tool.

Statement 13. The method of the statement 12, wherein the fluid is a bath oil.

Statement 14. The method of any one of the statements 12 or 13, wherein the valve plate includes a relief valve.

Statement 15. The method of any one of the statements 12-14, wherein the valve plate is configured to open or close based on pressure exerted on the valve plate by the fluid.

Statement 16. The method of any one of the statements 12-15, further comprising shifting a ball in the downhole tool upon shifting of the inner mandrel and the valve plate.

Statement 17. The method of any one of the statements 12-16, wherein the valve plate includes a seal that is disposed between the outer sleeve and the valve plate.

Statement 18. The method of any one of the statements 12-17, wherein the valve plate is disposed between two sections of a chamber filled with the fluid.

Statement 19. The method of any one of the statements 12-18, further including a piston movably disposed on the inner mandrel.

Statement 20. The method of any one of the statements 12-19, wherein the piston separates the fluid from a wellbore fluid.

Although the present disclosure and its advantages have been described in detail, it should be understood that various changes, substitutions, and alterations may be made herein without departing from the spirit and scope of the disclosure as defined by the appended claims. The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the elements that it introduces.

For the sake of brevity, only certain ranges are explicitly disclosed herein. However, ranges from any lower limit may be combined with any upper limit to recite a range not explicitly recited, as well as ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A downhole tool comprising:

an outer sleeve;

a tapered portion on an interior portion of the outer sleeve;

an inner mandrel; and a valve plate coupled to the inner mandrel, the valve plate and the inner mandrel configured to shift axially within the outer sleeve such that the valve plate moves axially along the tapered portion, the valve plate further configured to pass a portion of fluid through the valve plate when a tensile force is applied to the inner mandrel and pass another portion of the fluid around the valve plate and through the tapered portion when a compressive force is applied on the downhole tool.

2. The downhole tool of claim 1, wherein the valve plate includes a relief valve.

3. The downhole tool of claim 1, wherein a seal is disposed between the valve plate and an interior of the outer sleeve and adjacent to the tapered portion.

4. The downhole tool of claim 1, further comprising a ball disposed in the downhole tool, the ball configured to shift in the downhole tool upon shifting of the inner mandrel and the valve plate.

5. The downhole tool of claim 1, wherein the valve plate is disposed between two sections of a chamber filled with the fluid.

6. The downhole tool of claim 1, wherein the valve plate is configured to open or close based on pressure exerted on the valve plate by the fluid.

7. The downhole tool of claim 1, further comprising a piston movably disposed on the inner mandrel.

8. The downhole tool of claim 7, wherein the piston separates the fluid from a wellbore fluid.

9. A method comprising:

applying a compressive force or a tensile force to a downhole tool to shift an inner mandrel of the downhole tool, the tool including:

an outer sleeve;

an inner mandrel; and a valve plate coupled to the inner mandrel, the valve plate and the inner mandrel configured to shift axially within the outer sleeve, the valve plate further configured to pass a portion of fluid through the valve plate when a tensile force is applied to the inner mandrel and pass another portion of the fluid around the valve plate and through a tapered portion when a compressive force is applied to the inner mandrel.

10. The method of claim 9, wherein the fluid is a bath oil.

11. The method of claim 9, wherein the valve plate includes a relief valve.

12. The method of claim 11, wherein the valve plate is configured to open or close based on pressure exerted on the valve plate by the fluid.

13. The method of claim 12, further comprising shifting a ball in the downhole tool upon shifting of the inner mandrel and the valve plate.

14. The method of claim 13, wherein the valve plate includes a seal that is disposed between the outer sleeve and the valve plate.

15. The method of claim 13, wherein the valve plate is disposed between two sections of a chamber filled with the fluid.

16. The method of claim 15, further comprising a piston movably disposed on the inner mandrel.

17. The method of claim 16, wherein the piston separates the fluid from a wellbore fluid.

18. A downhole tool comprising:

an outer sleeve;

a tapered portion on an interior portion of the outer sleeve;

an inner mandrel;

a first fluid chamber comprising a fluid;

a second fluid chamber comprising the fluid and fluidically coupled to the first fluid chamber;

a valve plate positioned in between the first fluid chamber and second fluid chamber such that a portion of the fluid can pass through the valve plate when a tensile force is applied to the inner mandrel while another portion of the fluid may pass around the valve plate when a compressive force is applied to the inner mandrel; and a balancing piston separating the first fluid chamber from a well fluid chamber.

19. The downhole tool of claim 18 wherein:

the valve plate travels axially along the tapered portion when the inner mandrel moves.

20. The downhole tool of claim 18 wherein:

the valve plate is pushed by the inner mandrel past the tapered portion to allow fluid to pass around the valve plate.

* * * * *